US005970159A

United States Patent [19]

McIntosh

[11] Patent Number: 5,970,159

[45] Date of Patent: Oct. 19, 1999

[54] VIDEO MONITOR WITH SHIELDED MICROPHONE

[75] Inventor: Jason McIntosh, Savage, Minn.

[73] Assignee: Telex Communications, Inc., Minneapolis, Minn.

[21] Appl. No.: 08/746,435

[22] Filed: Nov. 8, 1996

[51] Int. Cl.[6] ..... H04R 25/00

[52] U.S. Cl. ..... 381/365; 381/361; 381/357

[58] Field of Search ..... 381/168, 169, 381/205, 92, 88, 155, 355, 322, 356, 357, 360, 174, 306, 333, 388, 191

[56] References Cited

U.S. PATENT DOCUMENTS

| | | | |
|---|---|---|---|
| 4,424,419 | 1/1984 | Chaput et al. | 381/355 |
| 4,533,795 | 8/1985 | Baumhauer, Jr. et al. | 381/174 |
| 5,283,862 | 2/1994 | Lund | 395/155 |
| 5,438,530 | 8/1995 | Bettini | 364/790.11 |
| 5,640,457 | 6/1997 | Gnecco et al. | 381/322 |
| 5,651,074 | 7/1997 | Baumhauer, Jr. et al. | 381/170 |
| 5,749,744 | 5/1998 | Henderson et al. | 439/164 |

*Primary Examiner*—Huyen Le
*Attorney, Agent, or Firm*—Fredrikson & Byron, P.A.

[57] ABSTRACT

A video monitor assembly incorporating a microphone shielded from electromagnetic interference emitted by the monitor's electronic components. The assembly includes a video monitor having a housing with a microphone port and an interior cavity containing electronic components emitting electromagnetic interference. A microphone is mounted within the housing, the microphone being capable of detecting at least a portion of the electromagnetic interference emitted by the electronic components of the monitor. A shroud is secured within the housing, the shroud being made from an electromagnetic interference shielding material and at least partially surrounding the microphone to substantially reduce the microphone's detection of the electromagnetic interference emitted by the electronic components of the monitor.

15 Claims, 1 Drawing Sheet

VIDEO MONITOR WITH SHIELDED MICROPHONE

TECHINICAL FIELD

The invention relates to video monitors of the type used with computers, and particularly to a shielded microphone incorporated in such a video monitor.

BACKGROUND OF THE INVENTION

The power and speed of consumer and business desktop computers has recently reached the level that computers of even average performance frequently include multi-media capability. For most of these computers a microphone is an indispensable component. Microphones are used with computers not only for simple digital recording of sounds, but also for telephony, speech recognition applications, and the like.

Many computers employ a free standing microphone plugged in to the computer at a convenient (or sometimes inconvenient) location. Many manufacturers and users prefer, however, to integrate as many of the computer's peripheral components as possible to make setup easier and to reduce clutter on or around the desktop. Accordingly, some manufacturers are incorporating microphones into the video monitor, often with a port on the face (i.e., bezel) of the monitor pointing toward the user. Some of these microphones are directional, utilizing two ports. While incorporation of the microphone into the monitor bezel addresses the integration concerns noted above, it causes some additional problems.

In particular, the electronic components of video monitors emit electromagnetic radiation that frequently can be picked up by a microphone mounted in the monitor bezel—this electromagnetic radiation is detected as noise or interference, often sounding, e.g., like a hum or buzz. Electromagnetic radiation detected as noise or interference will be referred to hereafter as electromagnetic interference (or "EMI")

Many commercially available microphone cartridges are provided with some shielding from EMI. Nevertheless, leakage of EMI is common. Typically, shielding is partially accomplished by mounting the microphone element in a cylindrical metal enclosure or "can" which holds the microphone element. Usually the can holds a small circuit board at its back end, the electrical leads being secured to this circuit board. The can provides shielding from the sides, but does not shield the front or back of the microphone. Some shielding from the back may be provided by, e.g., a metal foil layer in the circuit board. Directional microphones, however, necessarily include a rear sound port through the circuit board, which obviously cannot be covered with shielding. Quality control in assembling the cartridges may sometimes be less than optimal, giving rise to leakage. Taking all of these practical considerations into account, applicant has found that conventional shielded microphone cartridges, even those of reasonably good quality, when employed in the bezel of a video monitor, detect a significant level of undesirable EMI.

Some electronic devices incorporate housings with electronic shielding to prevent (or at least reduce) significant emissions of EMI, so that the electronic device will not cause critical interference with other types of electronic devices designed to detect and receive electromagnetic radiation—the FCC has issued a variety of regulations governing such emissions and required shielding for some devices. Such shielding in these housings typically is not constructed in a manner that provides shielding of internal components from one another, however.

SUMMARY OF THE INVENTION

The invention provides a video monitor with a shielded microphone carried within the housing. The monitor includes a housing with a microphone port and an interior cavity containing electronic components emitting electromagnetic interference. The microphone is mounted within the housing, and is capable of detecting at least a portion of the electromagnetic interference emitted by the electronic components of the monitor. A shroud is secured within the housing, the shroud mounting the microphone in alignment with the microphone port in the housing, and substantially acoustically sealing the microphone from the interior cavity of the housing. The shroud is made from an electromagnetic interference shielding material to substantially reduce the microphone's detection of the electromagnetic interference emitted by the electronic components of the monitor. In a preferred embodiment the material is a resilient plastic impregnated with a conductive component such as carbon.

Preferably the shroud substantially envelopes the microphone except for one or more acoustic ports aligned with the microphone and an orifice sized to closely receive therethrough electrical wires connected to the microphone. Preferably the shroud is of a size, shape and orientation sufficient to effectively shade the microphone at least from direct-line electromagnetic interference emitted by the electronic components (i.e., ignoring reflected EMI). In a particularly preferred embodiment the shroud is sufficiently long that the microphone may be recessed within the shroud a distance from the shroud's acoustic port equal to at least one-half the diameter of the acoustic port, and the acoustic port is oriented in a direction so that the shroud shades the microphone from the direct-line electromagnetic interference emitted by the electronic components.

DETAILED DESCRIPTION OF THE INVENTION

Figure 1:
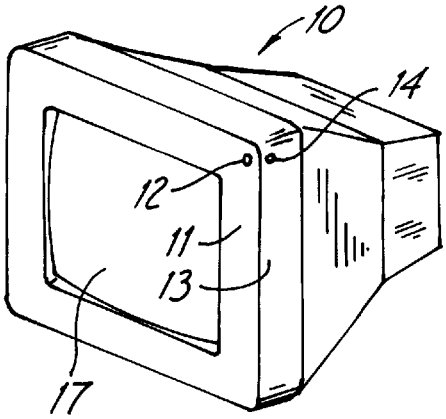
FIG. 1 is a perspective view of a video monitor of the invention.

FIG. 1 illustrates a typical video monitor 10 having a bezel 11 surrounding a display screen 17. The monitor includes a microphone port 12 through which sound may be admitted to a location containing a suitable microphone. While the microphone port 12 is illustrated as appearing in the upper right hand corner of the monitor, it will be appreciated that the microphone may be located at any suitable position on the monitor. For example, frequently such microphones are mounted in the center, top portion of the monitor bezel. Also, while FIG. 1 depicts a conventional CRT video monitor, the invention may be employed with other types of monitors and computers where EMI may be a problem.

Figure 2:
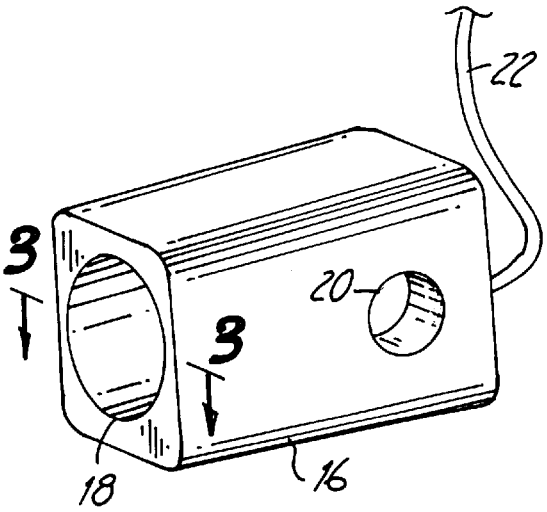
FIG. 2 is a perspective view of an EMI shielding shroud incorporated in the video monitor of FIG. 1.
Figure 4:
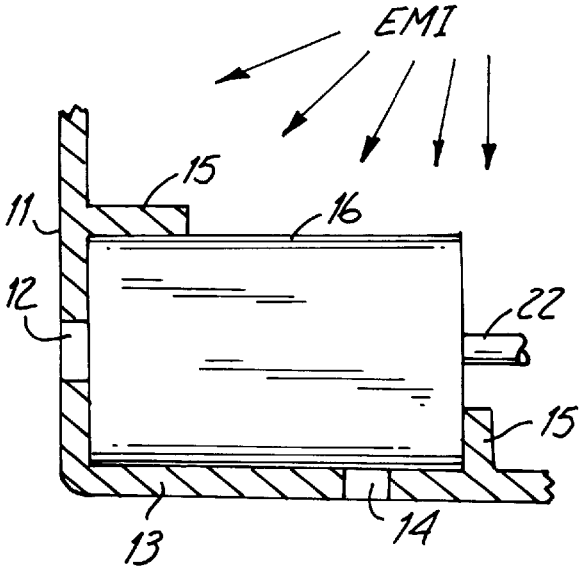
FIG. 4 is a view similar FIG. 3 but showing only the monitor housing wall in cross-section.
Figure 3:
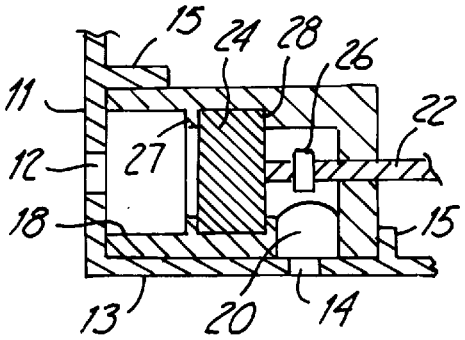
FIG. 3 is a cross-section of FIG. 2 taken along line 3—3 thereof, but also including a portion of the monitor housing wall.

FIG. 2 illustrates the shroud 16 of the invention in perspective view, and FIGS. 3-4 show the position of the shroud 16 mounted within the housing of the monitor 10. A microphone cartridge 24 is mounted within a central cavity formed in the shroud 16, the cartridge 24 having electrical wires 22 exiting the shroud 16 through a suitable opening. Preferably a conventional retainer device 26 is provided to secure the wires 22 within the shroud. As can be seen in FIG. 3, the shroud 16 may be molded to provide the central cavity with a circumferential ridge 27 and a circumferential shoulder 28 between which the microphone cartridge 24 is captured. Although the invention is usable in conjunction with omnidirectional microphones, the drawings illustrate an application of the invention with a directional microphone 24. To provide the requisite directionality, in addition to the front acoustic port 18 in the shroud 16 (and the corresponding port 12 in the monitor bezel 11), an additional side acoustic port 20 (and the corresponding port 14 in the monitor housing side 13), is provided to admit sound to the back side of the microphone cartridge 24.

The shroud 16 surrounds the microphone cartridge 24, and preferably also functions to mount the cartridge 24 in the desired location within the monitor housing, aligned with the ports 12 and 14 in the housing. Flanges 15 (or similar mounting structure) may be utilized to hold the shroud in its desired position in the monitor housing.

Preferably the shroud 16 is made from a somewhat flexible material. Use of such material facilitates insertion of the microphone cartridge 24 into the shroud 16, helps to isolate the microphone from vibrations and also acoustically seals the microphone. An acoustic seal reduces the detection of any sounds present within the monitor housing, such as 60 Hz and 120 Hz sound typically emitted by the electronic components of the monitor, as well as sounds that enter the monitor housing through other openings, such as ventilation slots, etc. The flexible nature of the shroud 16 also provides a good seal between the microphone cartridge 24 and the shroud 16, thereby providing the desired acoustical isolation of the front and back sides of the directional microphone cartridge. Alternately, harder plastics or metal could also be utilized, desirably with suitable gaskets or other conventional techniques for providing the desired acoustic seal and isolation of the microphone cartridge 24.

FIG. 3 illustrates the internal acoustical paths within the shroud of the preferred embodiment. A front acoustic path extends from the front microphone port 12 and through the acoustic port 18 of the shroud 16 directly (i.e., linearly—in a straight line) to the front side of the microphone cartridge 24. A second, rear acoustic path is non-linear. It extends from the side microphone port 14, through the acoustic port 20 of the shroud 16, around a 90° bend and then to the back side of the microphone cartridge 24. Preferably the two acoustic paths in this embodiment are of essentially the same length, in accordance with good directional microphone design.

The shroud is manufactured to include an electrically conductive material to shield the microphone cartridge from EMI generated by components within the computer monitor. Any of a variety of shielding materials may be utilized. For Applicant's preferred shrouds made from styrenic thermoplastic elastomers, Applicant has found that a carbon filler has worked well. Applicant has obtained a suitable carbon filled styrenic thermoplastic elastomer from RTP Company of Winona, Minn., under the product number RTP 2799 X 66439. It has the following characteristics:

| TEST | VALUE | | ASTM TEST METHOD |
|---|---|---|---|
| Specific Gravity | 1.06 | | D-792 |
| Molding Shrinkage, ⅛" | 0.015 | in/in | D-955 |
| Water Absorption, 24 hrs @ 23° C. | 0.1% | | D-570 |
| Tensile Strength | 50–150 | psi | D-638 |
| Tensile Elongation | 10+% | | D-638 |
| Shore Hardness, A | 60–70 | A | |
| Volume Resistivity, maximum | 100 | ohm-cm | D-257 |
| Surface Resistivity, maximum | 1000 | ohms/sq | D-257 |
| Static Decay, Mil 8-81705c, seconds | <2.0 | | FTMS-4016.1 |

Use of this shielding material showed significant improvement in the amount of EMI detected by a microphone mounted in a shroud. The following data compares essentially identical microphones in shrouds of essentially identical configuration, the shrouds being mounted flat on the glass of a computer monitor screen for test purposes. An HP 3582A spectrum analyzer was utilized to obtain data in 6 Hz band widths at the indicated frequencies. Data reported is the microphone output due solely to EMI detected. Values were measured in DBV rms, with a noise floor of −115 dBV; thus the test equipment was not able to detect noise at a level below −115 dBV, so that noise levels below that value are simply reported as −115 dBV.

| | 60 Hz | 120 Hz | 180 Hz | 240 Hz | 300 Hz | 360 Hz | 420 Hz |
|---|---|---|---|---|---|---|---|
| Without Shielding | −61 | −70 | −78 | −88 | −91 | −90 | −96 |
| With Shielding | −110 | −108 | −114 | −115 | −115 | −115 | −115 |

Desirably the shroud is of a size, shape and orientation sufficient to effectively shade the microphone at least from direct-line electromagnetic interference emitted by the electronic components (i.e., ignoring reflected EMI). Although any of a variety of shroud configurations could be utilized, preferably the shroud is of a length sufficiently long that the microphone cartridge 24 may be recessed within the shroud. Recessing the cartridge provides additional shielding since the angle of incidence of EMI entering the acoustic port is reduced as the cartridge is recessed further within the shroud. Preferably the front surface of the cartridge is recessed a distance within the shroud's acoustic port equal to at least one-half the diameter of the acoustic port. The effectiveness of the shroud's shielding may also be affected by the orientation of the acoustic ports with respect to the source(s) of EMI within the monitor. As illustrated in FIG. 4, preferably each of the acoustic ports is oriented in a direction so that the shroud shades the microphone from the direct-line EMI emitted by the electronic components.

The above-described shroud is generally L-shaped; other shapes and configurations of the shroud may also be employed to provide the desired EMI shielding, including, e.g., a generally U-shaped shroud (such as that shown in U.S. Pat. No. 5,226,076 which utilizes two acoustic ports on the side of the monitor), a generally straight shroud (used, e.g., with an omnidirectional microphone), or any other suitable shape.

While a preferred embodiment of the present invention has been described, it should be understood that various changes, adaptations and modifications may be made therein without departing from the spirit of the invention and the scope of the appended claims.

What is claimed is:

1. A video monitor microphone assembly comprising:

a video monitor having a housing having at least two microphone ports and an interior cavity containing electronic components emitting electromagnetic interference;

a directional microphone mounted within the housing, the microphone being capable of detecting at least a portion of the electromagnetic interference emitted by the electronic components of the monitor; and a shroud secured within the housing, the shroud being made from an electromagnetic interference shielding material and at least partially surrounding the microphone to substantially reduce the microphone's detection of the electromagnetic interference emitted by the electronic components of the monitor, the shroud includes at least two acoustic ports, each of the acoustic ports being aligned with one of the microphone ports of the video housing.

2. The assembly of claim 1 wherein the shroud substantially acoustically seals the microphone from the interior cavity of the housing.

3. The assembly of claim 1 wherein the shroud is made from a resilient material to facilitate acoustic sealing of the shroud against the housing.

4. The assembly of claim 1 wherein the shroud is made from an electrically conductive material.

5. The assembly of claim 1 wherein the shroud is made from an elastomeric material.

6. The assembly of claim 1 wherein the shroud is of a length sufficiently long that the microphone may be recessed within one of the acoustic ports a distance equal to at least one-half the diameter of the acoustic port.

7. The assembly of claim 1 wherein each of the acoustic ports comprises a hole in a wall of the shroud.

8. The assembly of claim 1 wherein at least one acoustic port is oriented in a direction so that the shroud shades the microphone from the electromagnetic interference emitted by the electronic components.

9. The assembly of claim 1 wherein the monitor housing includes a front bezel surface and an adjacent side surface, each of such surfaces having a microphone port.

10. The assembly of claim 1 wherein the monitor housing includes a front bezel surface and an adjacent side surface, one of the microphone ports being located on the side surface.

11. The assembly of claim 1 wherein the shroud substantially envelopes the microphone except for the acoustic ports and an orifice sized to closely receive therethrough electrical wires connected to the microphone.

12. A video monitor microphone assembly comprising:

a video monitor having a housing having at least two microphone ports and an interior cavity containing electronic components emitting electromagnetic interference;

a directional microphone mounted within the housing, the microphone being capable of detecting at least a portion of the electromagnetic interference emitted by the electronic components of the monitor; and a shroud secured within the housing, the shroud being made from an electromagnetic interference shielding material and at least partially surrounding the microphone to substantially reduce the microphone's detection of the electromagnetic interference emitted by the electronic components of the monitor, the shroud mounting the microphone in alignment with each of the microphone ports, the shroud defines a first internal acoustic path from a first of the microphone ports to the microphone, and a second internal acoustic path from a second of the microphone ports to the microphone, at least one of the internal acoustic paths being non-linear.

13. The assembly of claim 12 wherein the shroud is acoustically sealable to the housing to acoustically seal the microphone from the interior cavity of the housing.

14. The assembly of claim 12 wherein the shroud is made from a resilient material to facilitate acoustic sealing of the shroud against the housing.

15. The assembly of claim 12 wherein the microphone is contained within a microphone cartridge.

* * * * *